US005673941A

United States Patent [19]

Osawa

[11] Patent Number: 5,673,941

[45] Date of Patent: Oct. 7, 1997

[54] ROLLER SKI BOARD

[76] Inventor: Kazuo Osawa, No. 3-4, 3-Chome, Fuchu, Tokyo 183, Japan

[21] Appl. No.: 411,956

[22] Filed: Mar. 28, 1995

[30] Foreign Application Priority Data

Feb. 4, 1995 [JP] Japan ..... 7-053174

[51] Int. Cl.[6] ..... A63C 17/00

[52] U.S. Cl. ..... 280/842; 280/11.28; 280/87.042

[58] Field of Search ..... 280/7.12, 7.13, 280/7.14, 87.01, 87.021, 87.041, 87.042, 842, 11.91, 11.28, 28.5

[56] References Cited

U.S. PATENT DOCUMENTS

| | | | |
|---|---|---|---|
| 480,610 | 8/1892 | Nielson | 280/7.13 |
| 698,110 | 4/1902 | Foy | 301/5.3 |
| 876,245 | 1/1908 | Spacie | 280/7.13 |
| 2,644,692 | 7/1953 | Kahlert | 280/11.28 |
| 3,630,540 | 12/1971 | Smith | 280/87.042 |
| 4,708,352 | 11/1987 | Vullierme | 280/11.28 |
| 5,096,255 | 3/1992 | Osawa | 280/842 |
| 5,195,781 | 3/1993 | Osawa | 280/842 |
| 5,492,352 | 2/1996 | St. Clair | 280/87.042 |

FOREIGN PATENT DOCUMENTS

| | | | |
|---|---|---|---|
| 1075477 | 2/1960 | Germany | 280/87.042 |
| 2243268 | 3/1974 | Germany | 280/842 |
| 658357 | 10/1951 | United Kingdom | 280/7.13 |
| 837828 | 6/1960 | United Kingdom | 280/11.28 |

*Primary Examiner*—Richard M. Camby
*Assistant Examiner*—Frank Vanaman

[57] ABSTRACT

A roller ski board similar to an ordinary snow ski board having a board body with bending elasticity and repellent property and a plurality of roller pairs pivoted rotatively on an under-surface of the board body along its longitudinal axis. The roller pairs have a lubricity and a wear proof property with repellent elasticity so as to absorb the vibrations and shock added to the board from or to the ground during sliding. The plurality of roller pairs are arranged such that the distance between the internal side peripheries of each roller pair is identical and between the external side peripheries is gradually wider from the central portion to a front and rear edge so that the external side peripheries of each roller pair does not protrude over the contour curvature of the board body. The roller pairs are also arranged consecutively from both the front and rear edges to the central portion such that each running surface of the rollers contacts with an arc curvature slightly curved upwardly over the ground. The roller pairs have different diameters and are therefore arranged at different ground contact levels so as to reduce frictional resistance during sliding. The vertical sectional surface of each roller pair forms a small concave curvature with the contacting ground to achieve edging effects similar to an ordinary snow ski board.

18 Claims, 3 Drawing Sheets

ROLLER SKI BOARD

FIELD OF THE INVENTION

This invention relates to an improved grass ski board, and more particularly to an improved roller ski board in which the speed, stemming, sliding and turning is more easily controlled than the known prior grass roller ski board and compares to an ordinary ski board.

BACKGROUND OF THE PRESENT INVENTION

Customarily, various grass roller ski boards have been proposed for ski training on snow free ground. However, the moving peculiarities for sliding, turning, braking, etc., are completely different from the ordinary ski board, due to their inherent length and construction which provided multiple rollers or a caterpillar on the bottom surfaces of the boards, respectively.

In view of such shortcomings in the known grass roller ski boards, U.S. Pat. No. 5,096,225 and U.S. Pat. No. 5,195,781 disclose a grass ski board which has almost the same dimension and same flexibility as the ordinary ski board and is provided with many rotary rollers along a longitudinal axis of its under-surface to simulate the moving peculiarities of the ordinary ski board.

This known roller ski board, however, has not been able to satisfy the moving peculiarities such as for sliding, turning or speed and the feel of such movements, in comparison with the ordinary ski board, due to the large resistance from the many rotary rollers pivoting rotatively on the under-surface of the board.

SUMMARY OF THE PRESENT INVENTION

The present roller ski board comprises a board body provided with multiple bearing portions on its under-surface and a plurality of roller pairs pivoted rotatively on the bearing portions. The board body also is molded on the whole with the approximate same size and same form as the ordinary ski board, from various single and compound materials having a flexible and repulsive elasticity.

Each pair of rollers comprises a shaft supported firmly on the bearing portion of the roller ski board through a soft material and a pair of roller bodies supported rotatively on the shaft with a pair of rotary bearing portions. The pair of rotary bearing portions are molded from an organic material having a lubricative and wearing proof property, as an excellent rotary core material, and formed on the whole with a pair of roller bodies of soft synthetic resin material to form a pair of rollers.

Each pair of rollers is further arranged along a longitudinal axis of the under-surface of the board at the same distance from their respective both internal lateral side edges. Each pair of rollers pivots rotatively at a level lower than the bottom-surface of the board so that both tangential lines along the lateral outer side edges of each of the rollers does not protrude out from both lines along the lateral side edges of the board body. The body width at a central portion decreases gradually from each of the front and rear edges.

The board body is also formed in a shape of convex curvature slightly curved downwardly from a central portion to the front and rear both edges. Each roller arranged on the under-surface of the board body pivots rotatively at a respective position such that each circumference of the rollers contacts along a concave curvature slightly curved upwardly from a horizontal tangent line on a running surface of the rollers at the central portion of the board to both the front and rear edges.

On the other side, the board has a plurality of rotative roller pairs at its central portion consecutive with each pair of rollers at both the front and rear edges, respectively, which are of a smaller diameter than the rollers at the central portion and separated a little from the central rollers. All peripheries of the rollers are of a concave curvature to reduce the resistance of the board and to prevent an overturn of the user.

Additionally, each pair of rollers are supported rotatively on their respective shafts which is connected firmly on the bearing portion of the board through a bushing set of a soft material having a flexible and elastic property for absorption of vibrations and prevention of shock destructions to the board.

Further, the bearing portions of the board may be provided with slender through-holes; the roller bearing portion may also be set into the roller bearings or be provided with external circular holes about them; and the roller bodies may be arranged with many blind-holes or through-holes along their outer circular portions to provide a reduced weight for the board and absorption of the stress on the board or from the ground.

Accordingly, it is an object of the present invention to provide an improved roller ski board which is almost of the same form and dimension as an ordinary ski board and resembles closely with the same in operation.

It is an another object of the present invention to provide an improved roller ski board which is not only light and strong but also easily operative on a snow free area and has an excellent absorption capacity for shock and vibration as in an ordinary ski board due to the materials and construction of the roller ski board.

It is another object of the present invention to provide an improved roller ski board which provides a plurality of rotative roller pairs on its under-surface so that each circumference of the rollers contacts with a concave curvature slightly curved upwardly to the front and rear edges from a central point of a horizontal tangent line on the under circumference of the rollers in the central portion of the board, to provide a decreased resistance between the roller sliding surface and the ground surface.

It is a further object of the present invention to provide an improved roller ski board with a plurality of rotative pairs on its under-surface so that the distance of the internal lateral side edges of each pair of rollers is arranged on a bearing of the board is a constant and each distance of the outer lateral side edges decreases gradually from both the front and rear edges toward the central portion so as to form two tangent lines at the outer lateral side edges of each pair of the rollers accumulated with or within the lateral side lines of the board, for a smooth sliding and easy turning of the board.

It is still another object of the present invention to provide an improved grass ski roller board which provides a plurality Of rotative roller pairs at a central portion on an under-surface of the board consecutively and a respective pair of rollers at the front and rear edges somewhat separated from the central portion, for prevention of an overturn of the user.

It is still a further object of the present invention to provide an improved roller ski board which has rotatively a respective pair of smaller rollers than the central rollers at the front and rear edges, and in which all of the rollers are provided with a various uneven pattern on their running surfaces, such as a radial pattern, to provide an excellent edging effect similar to the ordinary ski board.

It is a further object of the present invention to provide an improved roller ski board which has on its under-surface a plurality of roller pairs wherein their vertical sectional surfaces makes respectively a small concave curvature slightly curved upwardly on the horizontal tangent line to achieve easily lateral inclination of the board to provide an excellent edging and a smooth operation.

It is still a further object of the present invention to provide an improved roller ski board which has a plurality of rotative rollers wherein each pair of rollers is supported on each shaft connected firmly with each bearing portion of the board through a respective bushing set of soft material to absorb vibration or the shock to the board.

It is still another object of the present invention to provide an improved roller ski board which has on its under-surface a plurality of rotative roller pairs wherein each pair of roller sets into a pair of roller bearings to increase the sliding speed of the board.

It is still another object of the present invention to provide an improved roller ski board which has a plurality of rotative roller pairs on its under-surface wherein each pair of rollers has various holes in the roller bodies for reducing weight and providing absorption of all stress to the board.

DESCRIPTION OF THE PREFERRED EMBODIMENTS

Figure 5:
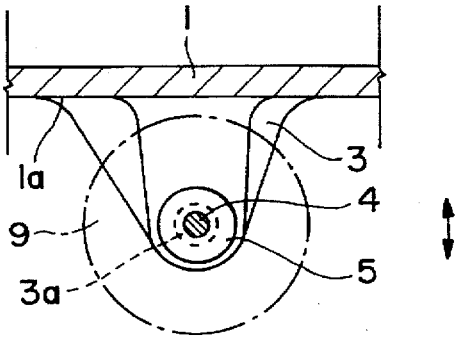
FIG. 5 is a partial sectional front view of a pair of rollers of the improved roller ski board shown in FIG. 1.
Figure 6:
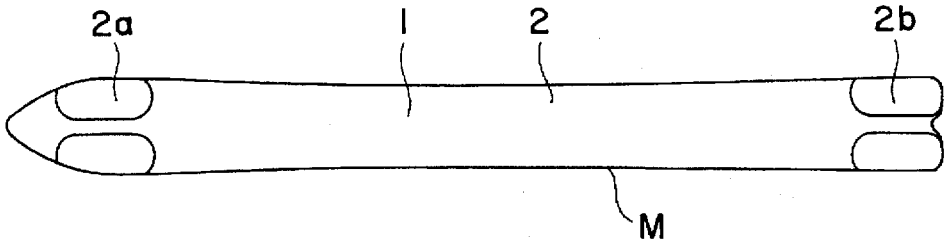
FIG. 6 is a plan view of another embodiment of the improved roller ski board.

The board B comprises a board body 1 provided with a plurality of bearing portions 3 and a plurality of roller pairs 9 pivoted rotatively on the later. The board body 1 and the bearing portions 3, as shown in FIG. 5, are molded on the whole from a light material such as a synthetic resin, glass fiber and light metal or light compound material such as a plywood, etc., so that they have a flexible and torsional elasticity, as in an ordinary ski board.

Figure 10:
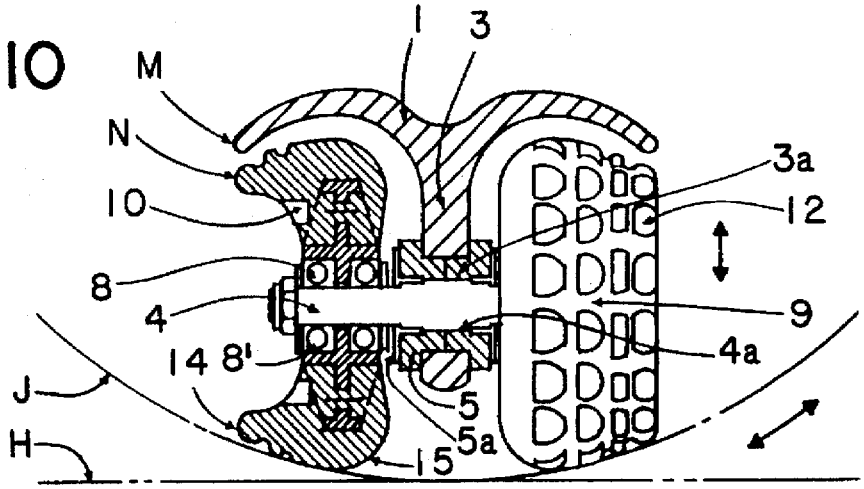
FIG. 10 is a partial sectional elongated side view for a bearing portion of an embodiment of the improved roller ski board.
Figure 11:
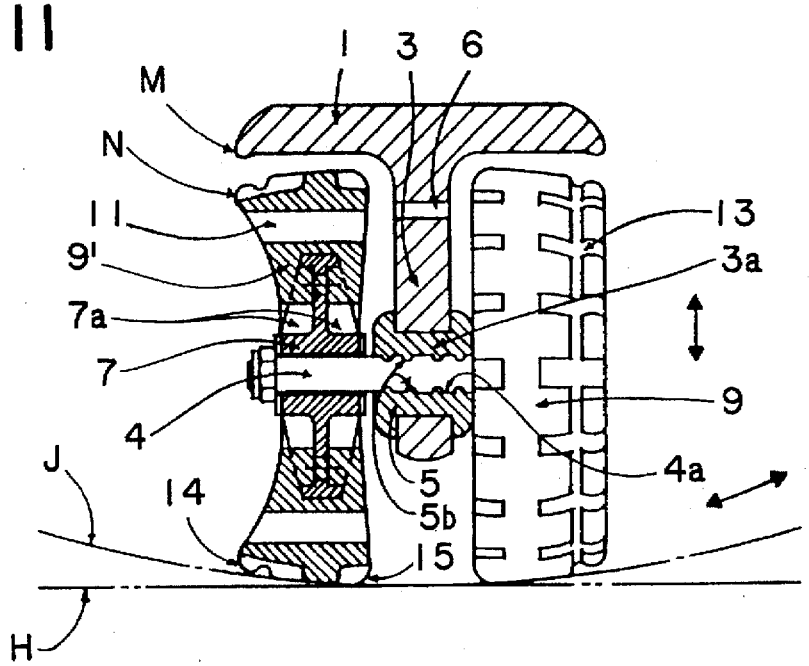
FIG. 11 is a partial sectional elongated side view for a bearing portion of another embodiment of the improved roller ski board.
Figure 12:
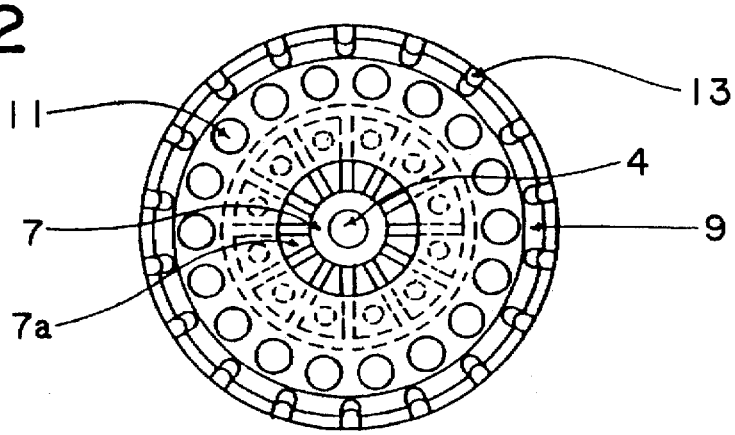
FIG. 12 is a front view of the roller ski board shown in FIG. 11.

As shown in FIGS. 10–12, roller 9 is formed from a rotary shaft portion 7 as a core material, which has respectively a lubricative property, a superior wear proof property, a superior shock proof property and a lower frictional property, with a roller body 9' as a soft roller main portion, providing a superior repellent elasticity such as urethane or rubber material, and is provided with outer circular holes **7*a* about the rotary shaft portion 7 to reduce weight and increase durability, as shown in FIG. 11**.

The plurality of the roller pairs 9 on the bearing portions 3 are mounted rotatively on the later along a longitudinal axis of the board body 1 at the same distance from the internal side periphery 15 between each pair of rollers at a level lower than a bottom surface **1*a* of the board body 1, so that both tangent lines N along the outer side periphery 14 of each roller pair 9 does not protrude over the side lines M along the outside edges of the board body, and wherein the width of a central portion 2 decreases gradually from front and rear edges 2*a*, 2*b*** to make a more easier smooth sliding, turning, circling, etc., than the known roller ski board which has a reversed configuration as compared to the roller ski board of the present invention.

The board body 1 is formed in the shape of convex curvature along its lateral axis such that both the front and rear edges **2*a*, 2*b* approaches equally to a horizontal tangent line H of central roller pair 9 form the central portion 2, respectively, and the front edge 2*a* is formed the same as in an ordinary ski board which is slightly bent upwardly. All pairs of rollers 9 are arranged on the under-surface 1*a* of the board body 1 and respectively pivot rotatively at a respective position such that each circumference of the rollers contacts with a concave curvature L which is slightly curved upwardly from a horizontal tangent line H on the circumference of the roller 9 at the central portion 2 of the board 1 to both edges. On the other side, all pairs of rollers 9 are arranged in such a manner that a plurality of larger roller pairs, for example, four pairs, are set consecutively at the central portion 2 and two pairs of small rollers, at both the front and rear edges are separated from the central portion 2**, so that all the peripheries of the rollers are on the concave curvature L.

Figure 1:
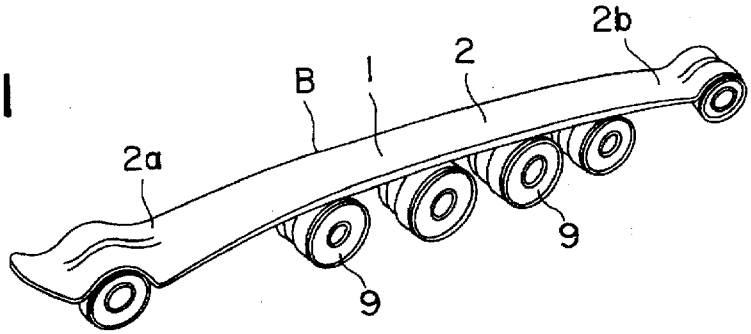
FIG. 1 is a perspective view of an improved roller ski board of the present invention.
Figure 2:
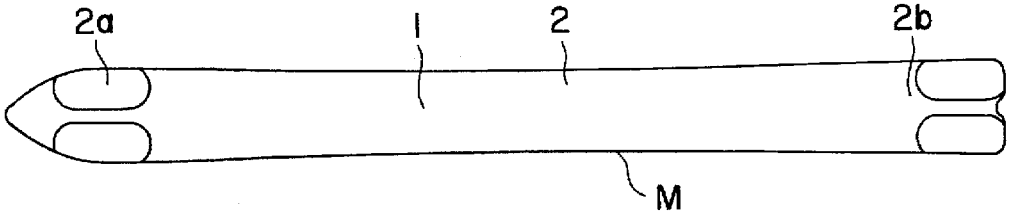
FIG. 2 is a plan view of the improved roller ski board shown in FIG. 1.
Figure 3:
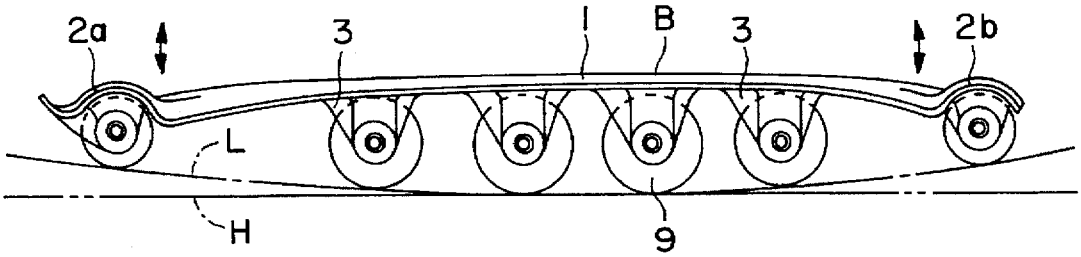
FIG. 3 is a front view of the improved roller ski board shown in FIG. 1.
Figure 4:
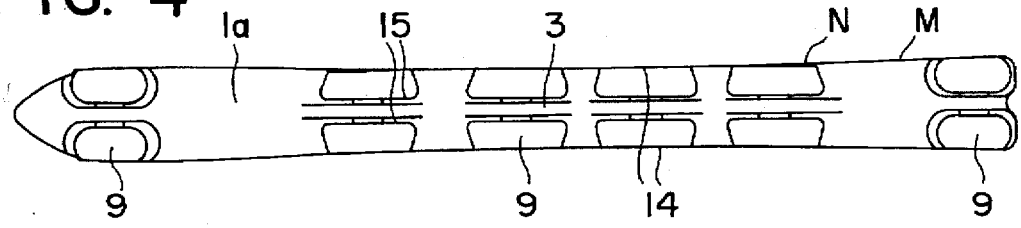
FIG. 4 is a bottom view of the improved roller ski board shown in FIG. 1.
Figure 7:
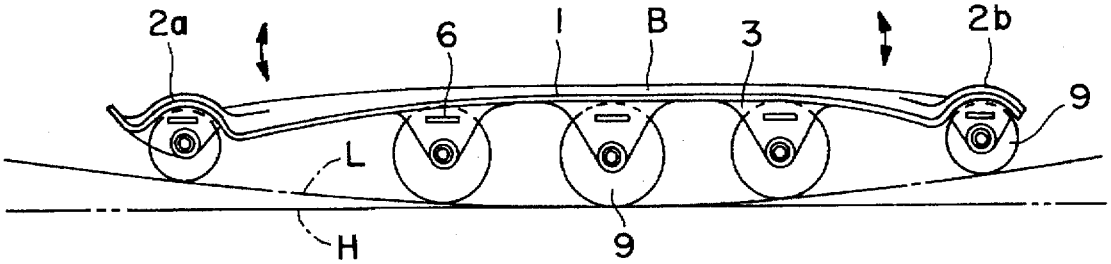
FIG. 7 is a front view of the improved roller ski board of FIG. 6.
Figure 8:
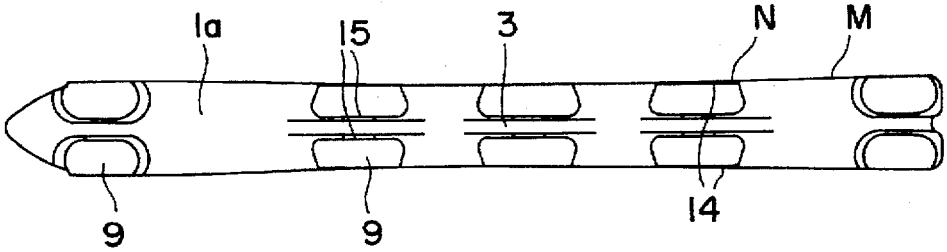
FIG. 8 is a bottom view of the improved roller ski board shown in FIG. 6.

Accordingly, an added load during sliding is distributed consecutively on a plurality of roller pairs 9 in the central portion 2 and the frictional resistance added on all rollers is decreased remarkably, while the small roller pairs on both edges **2*a*, 2*b*, which are respectively raised up and separated a little from the central portion 2, prevents an over-turn of the user when there is movement along the vertical arrows as shown in FIGS. 3 and 7** and when the balance of the user is disturbed for some reason.

Additionally, all rollers 9 pivot rotatively on the under-surface **1*a* of the board body 1 to display the various moving characteristics of the edging effects provided by an inclination of the board body, due to their diameters being decreased from the central portion 2 to both front and rear edges 2*a*, 2*b*** in order and to various uneven patterns formed on the roller surfaces.

Further, all roller pairs which pivot rotatively on the under-surface **1*a* of the board 1 are arranged so that a vertical sectional surface of each pair of rollers 9 makes a small concave curvature J slightly upwardly, as shown respectively, by an arrow in FIGS. 10 and 11, from the horizontal tangent H, whereby when the board is subject to an incline laterally there is a remarkable decrease in the frictional resistance of the rollers 9 on the ground during sliding. Consequently, a smooth operation and excellent stability of the board can be achieved with the sharp edging effect of the outer periphery 14 of the rollers 9** in the course of sliding.

A bushing set portion 5 held firmly on a roller shaft portion 4 is connected in a bearing through-hole 3*a* for a bearing portion 3 on the under-surface 1*a* of the board body 1. The bushing set portion 5 is also made of rubber for absorption of vibration or of soft materials, such as polyurethane, etc., thereby providing an elasticity and vibration absorbing capacity to form a flex structure which absorbs shocks, vibrations, etc., which take place in the course of sliding.

The roller ski board described hereinbefore may be provided with a binding at the central portion 2 of the board surface and used with a pair of boards with a known ski boot similar to the ordinary ski board; however, a wide single board may also be used for a pair of boards as mono roller ski board.

Referring to FIGS. 6 to 9, another embodiment of the roller ski board is illustrated having an additional construction whereby its principle is almost similar to the embodiments of FIGS. 1 to 5.

Figure 9:
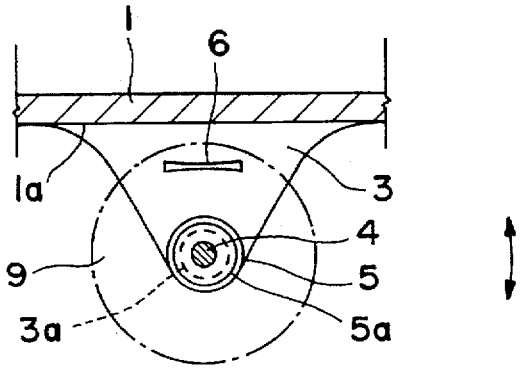
FIG. 9 is a partial sectional front view of the improved roller ski board shown in FIG. 6.

As shown in FIG. 9 a suitable slit 6 is cut into an upper portion of a bearing portion 3 on an under-surface 1*a* of the roller ski board body 1 and the board body 1 is partially separated from a periphery of the bearing portion 3 to absorb vibration transferred to the board body 1 during sliding. The slit 6 may be in the form of a slender rectangle, circle, semi-circle, ellipse, square, etc., respectively, and may be a plurality of little through-holes in the same place or a blind-hole.

Referring to FIG. 10, another embodiment is illustrated in the same manner as the above second embodiment.

A divided bushing set 5 is inserted elastically into a bearing portion 3 of the board body 1, and thereafter a roller shaft portion 4 is also inserted into a through-hole 4*a* of the divided bushing set 5. A connecting washer 5*a*, such as a screw washer, coupling washer, lock washer, etc., is also effectively used for tightening the roller shaft portion 4, as shown in FIG. 10. Consequently, the divided bushing set 5 is prevented from slipping down the bearing hole 3*a* due to an elastic pinch of itself, while the roller shaft portion 4, from the through-hole 3*a* of the bearing portion 3 with the divided bushing set 5, due to tightening of the washer 5*a*.

The rotary shaft portion 7, which forms part of core for each roller 9, consists of an organic material having an excellent lubricating property and wear-proof property. Alternately, roller 9 can improve remarkably its rotary speed by replacing it with a bearing shaft portion 8 including a roller bearing 8', as shown in FIG. 10.

The roller 9 can also achieve durability by forming, in a body, the rotary shaft portion 7 or the roller bearing shaft portion 8, with a soft material having a repellency and elasticity, selected from a plastic resin group of the hard plastics, semi-hard plastics, soft plastics, etc. Further, the roller 9 may be provided with a plurality of lateral blind-holes 10, which may also be through-holes, at an outer periphery portion of the roller bearing shaft portion 8, or at one side or both sides of the roller 9 itself, and the respective hole may also be of a small or large circular configuration, semi-circular configuration, elliptical configuration or rectangular configuration. Thus, the roller can permit weight reduction and remarkably absorb vibrations and shocks from or to the ground as shown by the vertical arrow in FIGS. 5, 10, and 11.

Each diameter of the rollers 9 pivoted on an under-surface 1*a* of the board body 1, may become smaller in order, from the central portion 2 to both the front and rear edges 2*a*, 2*b* along an arc line L, as shown in FIGS. 3 and 9, so that the frictional resistance arising between the rollers 9 under both edges and the ground, decreases proportionally with the difference of the diameter for each roller 9, which is contacting with the ground, during sliding. Each sliding surface of the rollers 9 may be provided with various uneven patterns, for example, a thrust pattern 12, according to a condition of the sliding ground surfaces.

Each vertical sectional surface of a pair of rollers 9 may be formed as an arc configuration having a little curve upward from the ground surface, such as a concave curvature J, as shown in FIG. 10, as mentioned before, or it may also be formed as a rectangular or a semi-circular configuration, etc. Consequently, the board body 1 can be easily inclined laterally, owing to the concave curvature along the vertical sectional surface of each pair of rollers 9, to decrease much more of the frictional resistance, and can be operated smoothly and safely as with an ordinary ski board, due to the edging effect of the respective outer periphery 14 of the rollers 9.

Referring to FIGS. 11 and 12, a further embodiment of the roller ski board is illustrated hereunder in the same manner as the above embodiments.

In this embodiment, a bushing set 5 is provided with a plurality of grooves 5*a* inside a through-hole 4*a*, is first elastically inserted into a bearing shaft hole 3*a* of the board body 1, and is connected adhesively inside the bearing shaft hole 3*a*, so that the bushing set 5 does not slip down from the bearing shaft hole 3*a*. A roller shaft portion 4 provides on its surface a plurality of grooves 5*b* relative to the through-hole 4*a* of the bushing set 5, is inserted forcibly into the through-hole 4*a* to prevent the omission of the roller shaft portion 4 from the through-hole 4*a* of the bushing set 5.

A rotary shaft portion 7 of the rollers 9 may be molded, in a body, from an organic core material having an excellent lubricative and wear-proof property, with a soft material consisting of an organic resin selected from a group of hard, or a semi-hard, or a soft plastics, etc., and having a torsional elasticity, and moreover may be provided with external circular holes 7*a* at an outer periphery portion of the rotary shaft portion 7, to decrease weight and to absorb vibration of the board body 1.

Further, the roller 9 may be provided with a plurality of lateral through-holes 11 at an outer periphery portion of the roller body 9', separated from the external circular holes 7*a*, to decrease weight and vibration or shock of the board body 1. The lateral through-holes 11 through the rollers body 9' may be replaced by a lateral blind-hole 10, as shown in FIG. 10, and also its configuration may not only be a large or small circular configuration, but also semi-circular, rectangular or elliptical configuration, respectively.

Each diameter of the roller 9 pivoted on an under-surface 1*a* of the board body 1 may become smaller in order from the central portion 2 to both the front and rear edges 2*a*, 2*b* along an arc line L, as shown in FIGS. 3 or 9, so that the frictional resistance, arising between the roller 9 under both edges 2*a*, 2*b*, and the ground, decreases proportionally with the difference of the diameter for each roller 9 which is contacting the ground during sliding. Each sliding surface of the rollers 9 may be provided with various uneven patterns, for example, a radial pattern 13, according to a condition of the sliding ground surface.

Each vertical sectional surface of a pair of rollers 9 may also be formed as an arc configuration of a little curve upwardly from the ground surface, such as a concave curvature J, as shown in FIG. 10, or as a rectangular, a semi-circular configuration, etc. Consequently, the board body 1 can easily be inclined laterally, owing to the concave curvature along the vertical sectional surface of each pair of rollers 9, to decrease much more of the frictional resistance, and can be operated smoothly and safely as with an ordinary ski board, due to an edging effect of the respective outer periphery 14 of the rollers 9.

While there has been described and pointed out the fundamental features of the invention as applied to preferred embodiments, it will be understood that various omissions and substitutions and changes in the form and details of the roller ski board illustrated and many modifications may be made by those skilled in the art, without departing from the spirit of the invention.

The invention, therefore, is limited only as indicated by the scope of the following claims;

I claim:

1. A roller ski board to be used on a snow-free ground surface comprising:

a plurality of individual pairs of rotatable roller means disposed along a longitudinal axis and on an under-surface of a board body for contacting with the surface, the board having a central portion and longitudinal extent defined by respective side edges extending from a front edge portion to a rear edge portion and a curved contour extending from the front edge portion to the rear edge portion, each of the pairs of roller means having an internal and an external side periphery, all of the plurality of pairs of individual roller means as a whole having a periphery which forms a tangential arc of an upward concave curvature with respect to the contacting ground surface and wherein the arc extends between the front edge portion and the rear edge portion and has an orientation substantially opposite; to the curved contour of the board body.

2. The roller ski board of claim 1 wherein the board body supports the pairs of roller means by a bearing portion, the board body and the bearing portion being formed from a light material, wherein the material is synthetic resin, glass fiber, metal, or plywood, and wherein the material has a desired bending elasticity and the roller means having a core portion formed from a resin material wherein the resin material is hard plastics, semi-hard plastics or soft plastics.

3. The roller ski board of claim 1 wherein each roller means pivots so that a roller surface conforms to an arc curvature slightly curved upwardly over the contacting ground surface from the central portion to the front and rear edge portions.

4. The roller ski board of claim 1 wherein a vertical section through the roller means has a running contact surface which forms a concave curvature relative to the contacting ground surface.

5. The roller ski board of claim 1 wherein a bushing set portion means is connected in a bearing portion of the board for supporting a shaft for the respective roller means, the bushing set portion means comprising a material for absorbing vibrations and shocks.

6. The roller ski board of claim 1 wherein a slit is cut on a bearing portion supporting the roller means to absorb vibrations and shocks.

7. The roller ski board of claim 1 wherein the roller means has a rotary shaft portion of a first material having a given hardness for supporting a roller bearing and a portion surrounding the rotary shaft portion of a second material having a lesser hardness than the first material.

8. The roller ski board of claim 1 wherein circular holes are disposed in the roller means about an outer surface of a rotary shaft of the roller means.

9. The roller ski board of claim 1 wherein the roller means have a plurality of holes.

10. The roller ski board of claim 1 wherein the roller means have an uneven peripheral pattern on a roller surface.

11. The roller ski board of claim 1 wherein the external periphery of the roller means does not extend laterally beyond the respective side edges of the board body.

12. The roller ski board of claim 1 wherein the board body with respect to the ground surface has a convex curvature in the central portion and upward convex curvature at the respective front and rear edge portions.

13. The roller ski board of claim 1 wherein the board body gradually widens from the central portion to the front edge portion and to the rear edge portion, respectively.

14. The roller ski board of claim 1 wherein a distance between the internal side periphery of the roller means is substantially equal.

15. The roller ski board of claim 1 wherein the plurality of roller means are disposed consecutively along the longitudinal axis on the under-surface of the board body and a pair of roller means is respectively disposed at the front and rear edge portions and spaced from the central portion.

16. The roller ski board of claim 15 wherein the roller means disposed at the front and rear edge portions are vertically spaced from the ground contacting surface.

17. The roller ski board of claim 1 wherein the front and rear edge portions have respective roller means on the under-surface of the board body and a diameter which is smaller than a diameter of the roller means disposed at the central portion.

18. The roller ski board of claim 17 wherein the roller means having the smaller diameter has a circumferential periphery which is tangential to the tangential arc.

* * * * *